US005261600A

United States Patent [19]

Cradeur

[11] Patent Number: 5,261,600

[45] Date of Patent: Nov. 16, 1993

[54] VERTICAL TUBE BUNDLE CLEANER

[75] Inventor: Robert R. Cradeur, Sulphur, La.

[73] Assignee: Serv-Tech, Inc., Houston, Tex.

[21] Appl. No.: 984,309

[22] Filed: Nov. 30, 1992

[51] Int. Cl.[5] ..... B05B 3/18; B05B 15/08

[52] U.S. Cl. ..... 239/753; 239/750; 239/DIG. 13; 134/172; 122/392; 165/95

[58] Field of Search ..... 239/750, 752, 753, 588, 239/DIG. 13, 722; 15/316.1; 134/172; 122/379, 381, 382, 392; 165/95

[56] References Cited

U.S. PATENT DOCUMENTS

| | | | |
|---|---|---|---|
| 1,694,371 | 12/1928 | Burdick . | |
| 2,494,380 | 1/1950 | Ellig . | |
| 2,839,970 | 6/1958 | Gaffney | 239/752 X |
| 3,060,064 | 10/1962 | Zingg . | |
| 3,225,777 | 12/1965 | Shelton et al. . | |
| 3,269,659 | 8/1966 | Shelton et al. . | |
| 3,389,713 | 6/1968 | Pittman . | |
| 3,448,477 | 6/1969 | Ricordeau et al. . | |
| 3,703,905 | 11/1972 | Ice, Jr. . | |
| 3,794,051 | 2/1974 | Lee, Jr. et al. . | |
| 3,817,262 | 6/1974 | Cradeur et al. . | |
| 3,901,252 | 8/1975 | Riebe . | |
| 3,903,912 | 9/1975 | Ice, Jr. et al. . | |
| 3,938,535 | 2/1976 | Cradeur et al. . | |
| 4,095,305 | 6/1978 | Goodwin . | |
| 4,214,704 | 7/1980 | Nagai | 239/753 |
| 4,218,016 | 8/1980 | Freund | 239/DIG. 13 X |
| 4,344,570 | 8/1982 | Paseman . | |
| 4,498,427 | 2/1985 | Todd . | |
| 4,509,544 | 4/1985 | Mains, Jr. . | |
| 4,611,613 | 9/1986 | Kaplan | 239/DIG. 13 X |
| 4,649,987 | 3/1987 | Frauenfeld et al. | 165/95 X |
| 4,691,723 | 9/1987 | Mierswa et al. | 239/DIG. 13 X |
| 4,805,653 | 2/1989 | Krajicek et al. . | |
| 4,856,545 | 8/1989 | Krajicek et al. . | |
| 5,002,120 | 3/1991 | Boisture et al. . | |
| 5,018,544 | 5/1991 | Boisture et al. . | |
| 5,022,463 | 6/1991 | Boisture et al. . | |
| 5,031,691 | 7/1991 | Boisture . | |
| 5,184,636 | 2/1993 | van der Woude | 134/172 X |

OTHER PUBLICATIONS

Australian Machinery & Production Engineering, vol. 31, No. 10 "Bundle Cleaning Problem Solved by WOMA" (Oct. 1978) p. 25.

G. Zank, et al. Proceedings of the 4th U.S. Water Set Conference "Rotary Waterblast Lancing Machines" (Aug. 26–28, 1987) pp. 155–158.

*Primary Examiner*—Andres Kashnikow
*Assistant Examiner*—William Grant
*Attorney, Agent, or Firm*—John R. Kirk, Jr.; Jennifer S. Sickler

[57] ABSTRACT

A tube bundle cleaner capable of cleaning vertical tube bundles by remote actuation by an operator is provided. To prevent binding of the flexible fluid supply conduit which supplies hydroblasting fluid to the manifold upon which the cleaning lances are mounted, a bight portion of the conduit extends toward the open end of the housing which slidably carries the manifold.

8 Claims, 8 Drawing Sheets

VERTICAL TUBE BUNDLE CLEANER

BACKGROUND OF THE INVENTION

This invention relates to a device for hydroblasting the inside of tubes in a tube bundle of a heat exchanger. In a specific application, this invention relates to the cleaning of the insides of tubes which comprise a tube bundle of a vertically mounted heat exchanger.

For many years, it was common practice to clean tube bundles using hand-held, manually operated cleaning lances which were supplied by high pressure exposed water hoses. It became apparent, however, that using hand-held lances was labor intensive and exposed workers to dangerous working conditions, because the high pressures used could burst a lance or a hose resulting in death or injury to the workers.

Recognizing this safety problem, equipment has been developed for lancing tube bundles allowing for remote operation of multiple lances, some with encased water conduits, thus reducing the potential for injury while, at the same time, increasing efficiency. For example, see U.S. Pat. Nos. 3,938,535; 4,805,653; 4,856,545; and 5,031,691 (all of which are incorporated herein by reference).

Unfortunately, such devices, while useful for cleaning horizontally mounted heat exchangers, do not adapt well for cleaning vertical heat exchangers, leaving them still to be cleaned by hand lances, resulting in the same, or greater, danger and inefficiency described above.

Examples of other tube bundle cleaners include the following patents, all of which are incorporated herein by reference: U.S. Pat. Nos. 2,494,380; 3,060,064; 3,225,777; 3,269,659; 3,448,477; 3,703,905; 3,817,262; 3,389,713; 3,794,051; 3,901,252; 3,903,912; 4,095,305; 4,344,570; 4,498,427; 4,509,544; 5,002,120; 5,018,544; 5,022,463. Tube bundle cleaners are also discussed in the following articles, which are incorporated herein by reference: "Bundle Cleaning Problem Solved by WOMA," *Australian Machinery & Production Engineering.* Vol. 31, No. 10, October 1978 and G. Zink, et al, "Rotary Waterblast Lancing Machines," *Proceedings of the Fourth U.S. Water Set Conference,* Aug. 26–28, 1987. Thus, it is clear that the cleaning of heat exchangers is a problem meriting continuing scrutiny and judgment.

One earlier tube bundle cleaner has been found to be capable of cleaning vertical tube bundles, namely that shown in U.S. Pat. No. 1,694,371, also incorporated herein by reference. However, the '371 device was little more than an oversized little washer using brushes or some other mechanical head to clean refrigerator tubes. Also, the '371 device required a number of cleaning heads equal to the number of tubes in the bundle, resulting in a dedicated device for each pattern of tube bundles, a requirement not suited to heat exchangers in refineries, due to the wide variety of sizes and tube patterns and the infrequency of use.

Without an automated vertical heat exchanger tube bundle hydroblasting apparatus, those needing to clean the tubes of a vertical tube bundle cleaner must either use the dangerous hand lances on the bundle, in situ, or the vertical tube bundle must be removed to a horizontal cleaning area. In many cases, such removal will require dismantling of the structure around the tube bundle—a costly proposition. Transportation is required to a horizontal cleaning station, and the tube bundle must then be reinserted after horizontal cleaning.

Earlier automated tube bundle lancing devices, such as described in the '545, the '653 and the '691 patents, are not suited for cleaning vertical heat exchangers due to a binding problem which occurs if the horizontal lancing devices are turned to be used in an upright position. While lances could be advanced into the tubes from a vertical position, parts such as hoses and chains become trapped and bound when retraction of the lances is attempted, thus rendering the equipment inoperable.

Even if the bind is not so great as to prevent retraction, the power required to advance and retract the lances will be necessarily larger than if there was no binding thus reducing any advantage of mechanization.

Thus, the need continues for a tube bundle cleaner capable of cleaning vertical tube bundles with a plurality of lances without the binding problems of the earlier devices, while allowing the versatility of using the same device on a variety of bundle patterns, and while allowing the operator to position himself at a location safe from high pressure spray during the cleaning operation.

SUMMARY OF THE INVENTION

The present invention provides a tube bundle hydroblasting device which allows for remote controlled multiple lance operation to clean vertical tube bundles in situ, eliminating the time consuming (and many times dangerous) requirement of removal of the tube bundle for cleaning. The apparatus can be suspended above the heat exchanger and hydroblast lances extended into and retracted from the tubes. The hydroblast lances are attached to a moving water fed manifold block. It has been discovered that by the positioning of the bight portion of the hose conveying water to the flock in the direction of the end of the device through which the lances extend and retract, and by positioning the output portion of the hose in parallel with the lances, the binding problem associated with earlier devices designed for horizontal use is avoided. This allows, for the first time, satisfactory automated vertical tube bundle cleaning.

According to one embodiment of the invention, there is provided a device for use with a main fluid supply conduit for simultaneously hydroblasting the interior of a plurality of tubes in a heat exchanger tube bundle. The device includes a housing having an input port adapted to receive the main fluid supply conduit carrying the water, an open end which allows the cleaning lances to move back and forth, a closed butt end providing a place for attachment of hanging apparatus, and sides defining a main chamber housing the operating mechanism and a lance chamber to house the lances. The main chamber and the lance chamber are separated within the housing by a manifold channel.

Also provided is a manifold, slidably carried along the manifold channel and having a manifold input in fluid communication with a plurality of manifold output openings, and a flexible fluid supply conduit connected between the input port and the manifold input openings to carry the blasting fluid, usually water, to the manifold. The flexible fluid supply conduit is connected to the manifold such that when the manifold is in a lance retracted position from the tube bundle, the bight portion of the flexible fluid supply conduit hangs toward the open end, from which the lances also extend.

Physically connected, and in fluid communication with the manifold, are a plurality of hollow lances, each connected to one of the manifold outputs openings. The lances extend and retract through the open end in response to movement by the manifold Fluid, usually water, supplied by the main fluid supply conduit passes through the input port, through the flexible fluid supply conduit, through the manifold, and through the lances to impact, and dislodge fouling in the tubes.

The invention results in a remotely operable, multi-lance tube bundle cleaner, protecting operators from dangers of cleaning vertically oriented heat exchanger tubes, including high pressure hoses, and allowing for faster cleaning of vertical tube bundles.

BRIEF DESCRIPTION OF THE DRAWINGS

For a more complete understanding of the present invention and for further advantages thereof, reference is made to the following Description of Embodiments of the Invention taken in conjunction with the accompanying drawings, in which.

It is to be noted, however, that the appended drawings, which are not to scale, only illustrate typical embodiments of this invention, and are therefore not to be considered limiting of its scope, for the invention may admit to other equally effective embodiments.

DESCRIPTION OF EMBODIMENTS OF THE INVENTION

The following description of this invention sets forth information sufficient to enable one skilled in the art of the invention to build and use the automated remote control apparatus for cleaning heat exchanger tubes.

Figure 1:
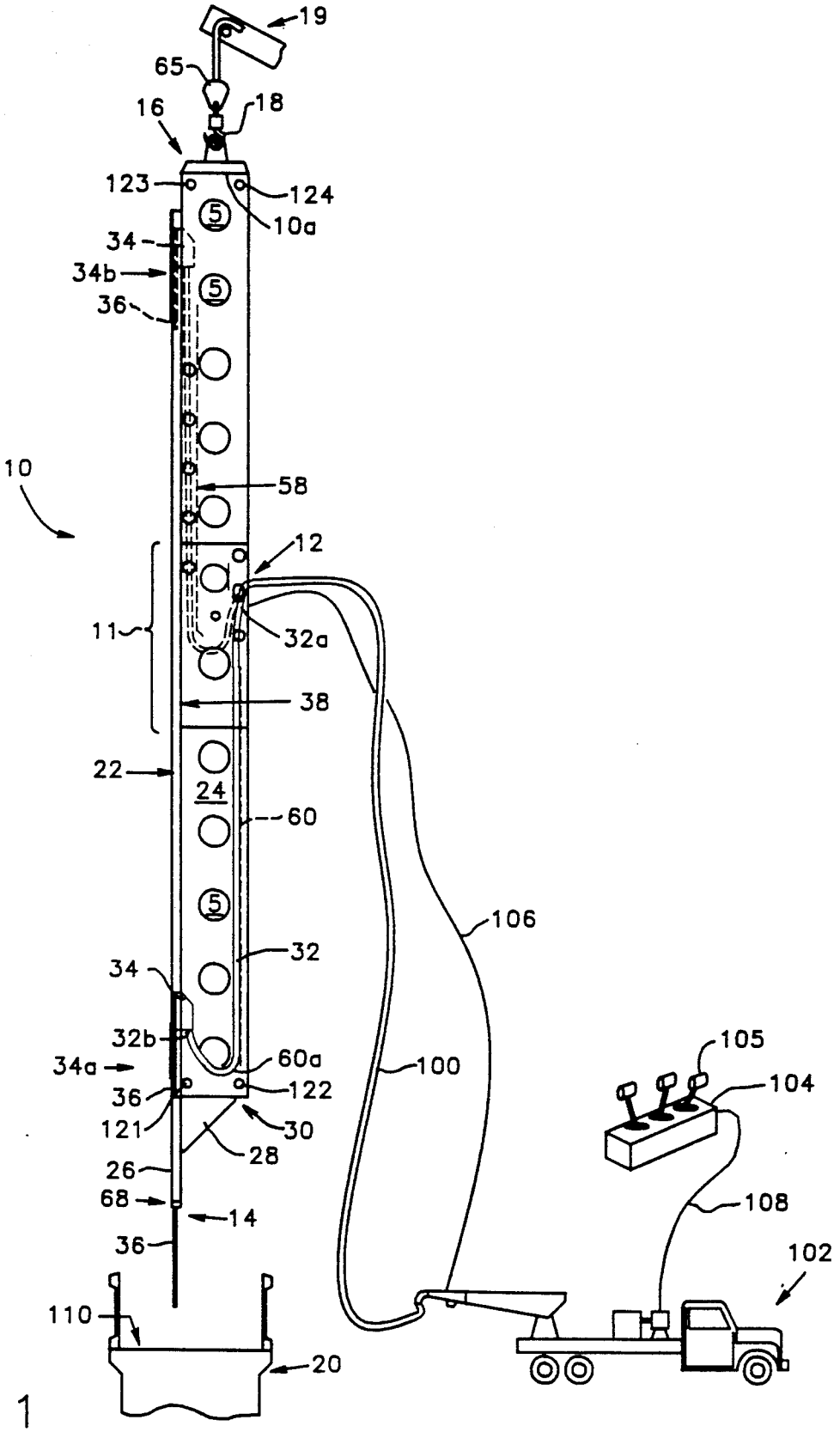
FIG. 1 is a side elevational view of an embodiment of the invention shown in schematic form in use with a vertical tube bundle showing the manifold in its lance extended and retracted position.

Referring to FIG. 1, an embodiment of the invention is shown comprising a housing 10 having an input port 12, a normally open proximate end 30 (closest to the heat exchanger), a closed distal end 10*a*. Distal end 10*a* is closed by plate 16 which includes a connector 18 for connection with a crane 19 or other means for lifting housing 10 and for holding housing 10 above a vertical heat exchanger 20. Typically, connector 18 should be capable of holding at least about 1,500 lbs. deadweight and take at least a 3,000 lb. vertical shock force, since this type of equipment is relatively heavy. Provided within housing 10 is a lance chamber 22 and a main chamber 24. A lance chamber extension 26 is also provided, which extends past open proximate end 14 of the lance chamber 22. A support member 28 is connected between the proximate end 30 of the main chamber 24 and a lance chamber extension 26 leaving an opening 14 through which lances 36 pass. Holes 5 are provided to reduce the weight of the device and provide access to various components for assembly and maintenance.

A flexible fluid supply conduit 32 (for example, a water hose) is also provided which includes an input portion 32*a* connected to input port 12, and an output portion 32*b*, connected to a manifold 34. Input port 12 is located about half way between the ends of the housing 10 in the mid-region 11 to minimize the length of flexible fluid supply conduit 32 and thereby reduce the chance that flexible fluid supply conduit 32 will bind within main chamber 24. An acceptable embodiment of an input port 12 for use with the present invention is a plurality of hoses which attach to an external supply of water or an attachment to which a high volume source of water may be attached as will be understood by those of skill in the art.

Flexible fluid supply conduit 32 according to one embodiment, comprises multiple hoses preferably having a pressure rating of about 20,000 PSI minimum burst. According to one embodiment, the hoses are shrouded in a drag chain (a/k/a "reel") and are made of standard high pressure hose construction and materials suitable for fire hose service. Flexible fluid supply conduit 32 is connected between input port 12 and manifold 34 such that a bight portion 60*a* of flexible fluid supply conduit 32 drapes toward the open butt end 30 of housing 10, in main chamber 24. The manifold 34 defines a fluid communication path with a plurality of hollow lances 36 connected to the manifold 34 and the flexible fluid supply conduit 32. The lances 36 are extendable through the proximate end 30 of the housing 10 against the heat exchanger and opening 14 of lance chamber extension 26, by advancing and retracting manifold 34 through lance chamber 22.

Flexible fluid supply conduit 32 is connected to the manifold 34 such that when the lances 36 are retracted within housing 10, a substantial portion of the flexible fluid supply conduit 32 (the output portion 32*b*) is positioned in the main chamber 24 near the lance side 38 of main chamber 24 substantially parallel to lances 36. Positioning of the output portion 32*b* of flexible fluid supply conduit 32 substantially in parallel to the line of travel of the lances 36, reduces the number of bends and turns near the manifold which might bind within housing 10. Manifold 34 is seen in both its lance extended position 34*a* and lance retracted position 34*b* in FIG. 1 and schematically in FIGS. 3 and 5, respectively.

The flexible fluid supply conduit 32 is connected to the manifold 34 such that when the manifold 34 is retracted beyond (above) mid-region 11, no portion of the flexible fluid supply conduit 32 resides above the manifold 34, and flexible fluid supply conduit 32 forms bight 60*a* which drapes downward toward the proximate end 30 of housing 1, which also reduces the chances of binding during retraction.

Preferably, the main chamber 24 is of uniform dimension through the length of movement of the manifold 34.

Figure 2:
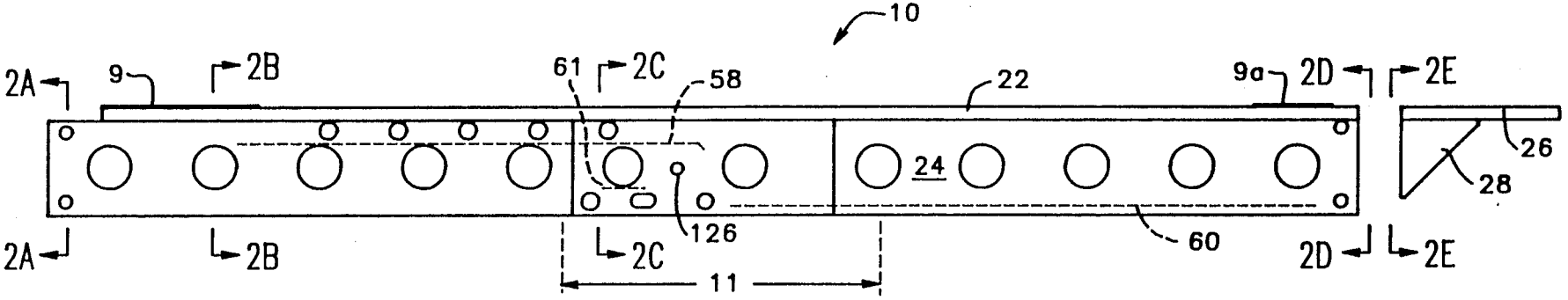
FIG. 2 is a side view of an embodiment of the invention showing the relationship between various subcomponents of the embodiment of FIG. 1.
Figure 2C:
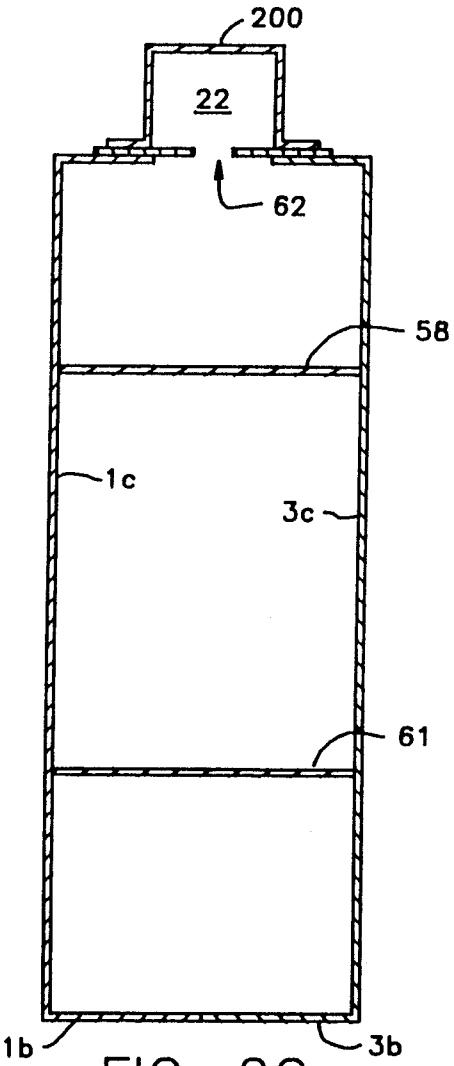
FIGS. 2A to 2E are cross-sectional views of various portions of the cleaning apparatus shown in FIG. 2.

Referring now to FIG. 2, a side view of housing 10 is seen with support web 28 and lance chamber extension 26 in detached relation to more fully illustrate particular details of this embodiment. Referring now to FIG. 2A, a section of housing 10 through line 2A—2A of FIG. 2 looking toward the distal end of the housing 10 is shown. According to the embodiment shown, housing 10 comprises two channel members 1 and 3. The dimensions and load-bearing characteristics of the housing 10, of course, will depend upon the size of the device which is dictated by the design of the heat exchanger to be serviced. Those skilled in the art can determine the appropriate dimensions or size. An example of acceptable material for channels 1 and 3 is stainless steel.

Referring still to FIG. 2A, channel members 1 and 3 are attached, preferably welded by 1 inch welds on 6 inch centers, such that there is an approximate three inch gap between short legs 1*a* and 3*a* (for the embodiment of FIG. 2A). Also seen in FIG. 2A are one inch angle iron 4, which are attached to channel members 1 (for example, by welding). The attachment of angle iron 4 should be sufficient to carry the weight of the housing 10 and other components by crane 19 (FIG. 1), because connected to flange members 4 by bolts through holes 6 is distal end plate 16 (FIG. 1), to which crane 19 is attached by any suitable crane attachment means 18 known to those of skill in the art.

All load bearing connections referred to herein, whether by welding or otherwise, should be made, in this preferred embodiment, to hold appropriate weight up to about a static weight of 1,500 pounds, and to withstand a 3,000 pound shock. Such connections are within the skill of those in the art. As a general rule of this, the design shock weight should be about twice the deadweight capacity.

Figure 2B:
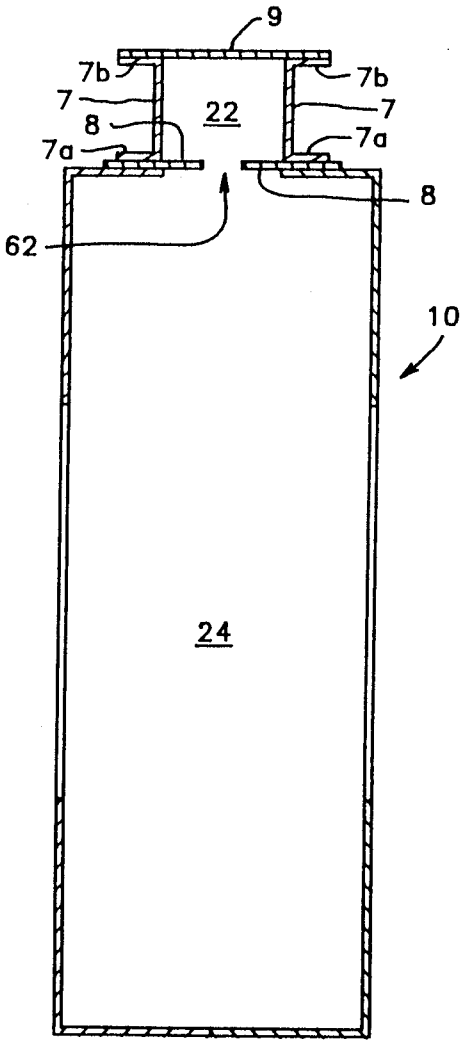
Figure 2A:
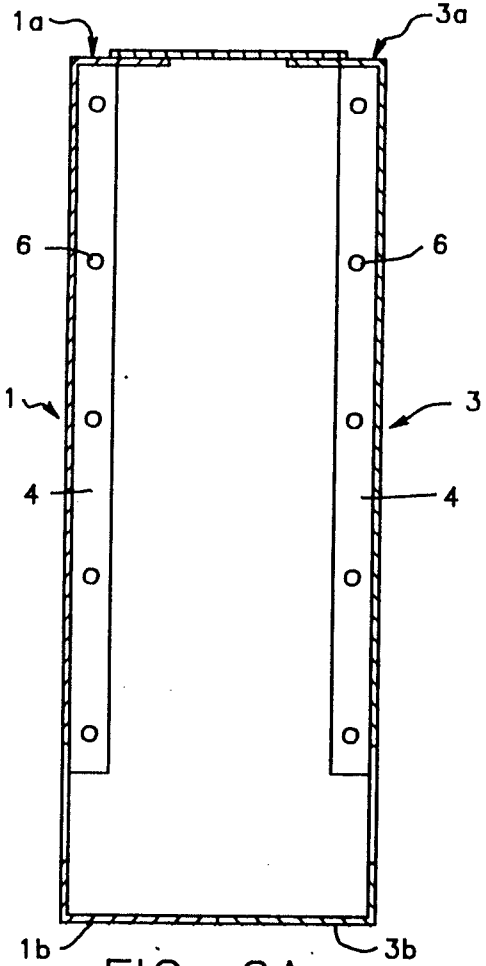

Referring now to FIG. 2B, a section of housing 10 through line 2B—2B of FIG. 2 is seen showing lance chamber 22, manifold guide channel 62, and main chamber 24. Lance chamber 22 is defined by channel members 7, removable access plate 9, and plates 8. Channel members 7 are spaced to provide as small a cross sectional area within lance chamber 22 as possible to support lances 36 (from FIG. 1). Referring now to FIG. 2, another access plate 9*a* (connected to housing 10 similarly to plate 9) is provided for access to manifold 34 in the extended position.

Referring again to FIG. 2B, manifold channel 62 is defined by a gap between plates 8. The size of the gap of manifold channel 62 depends on clearance required of the manifold, but should be minimized to avoid a bending lance from entering main chamber 24. Plates 8 and channel members 7 are attached by bolting together to provide for convenient replacement.

Figure 3:
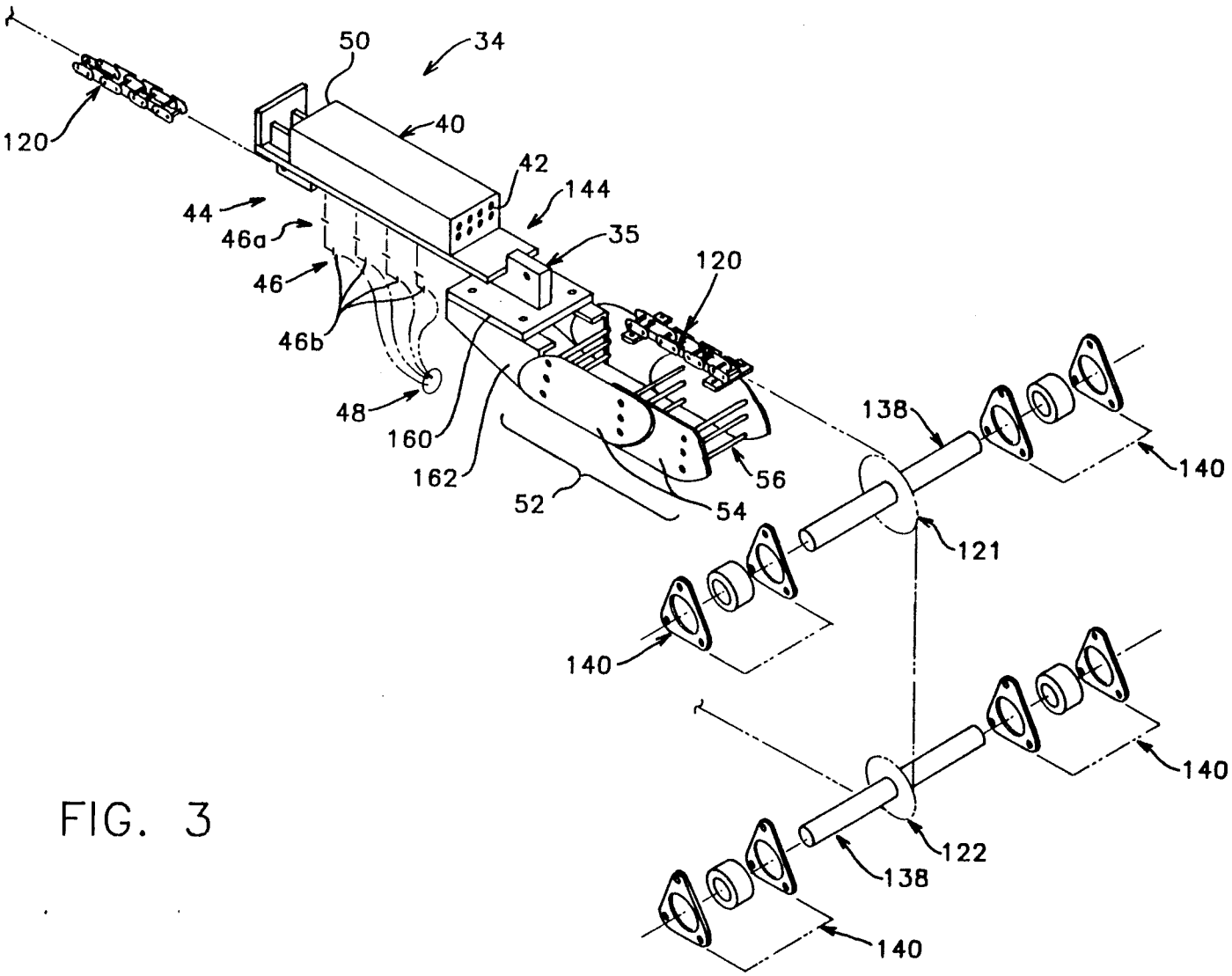
FIG. 3 is an exploded schematic view of the attachment assembly at the open end between a endless chain and manifold block used according to one embodiment of the invention for movement of the manifold and lances.

Referring now to FIG. 3, there is shown an embodiment of the manifold 34 having a substantially rectangular block 40 with a lance connection side 42 and a fluid supply side 44, wherein the lance connection side 42 and the fluid supply side 44 are substantially perpendicular to each other. Also shown, in schematic form, are short radius fluid connectors 46, which are attached to the fluid side 44 at manifold connection end 46*a*, and which are connected to flexible fluid supply conduit 32 (in this embodiment, a plurality of hoses) at fluid conduit connection ends 46*b* (as shown in FIG. 3). The openings of fluid conduit connection ends 46*b* face the proximate end 30 of housing 10 and position the flexible fluid supply conduit 32 as described above. An example of an acceptable fluid conduit connector comprises high pressure, L-shaped screw pipe fittings. According to an alternative embodiment, in which the fluid supply side is manifold butt end 50, which is parallel with the lance connection side 42, U-shaped connectors are used as the short radius connectors. The use of short radius connectors whose openings face the proximate end 30 of housing 10, avoids an unnecessary bend in flexible fluid o supply conduit 32, which must be a large radius bend extending towards the closed side 10*a* of housing 10 (see FIG. 1). The elimination of such a large radius bend reduces any upward tendency or orientation of a bight formed in fluid conduit 32, and thus reduces the clearance required, and the potential for binding. Reducing bends further reduces the chance of stress causing a hose failure and reduces the length of hose required, thus reducing the pressure drop between the fluid supply means and the manifold.

Referring still to FIG. 3 an embodiment of enclosure 52 for fluid conduit 32 is shown in which hoses 48 making up fluid conduit 32 are encased in a reel (a/k/a "drag chain") or other protective casing to reduce the chance of damage or injury in the event one of hoses 48 should break. According to the embodiment shown, enclosure 52 comprises a drag chain having links 54, connected by pins 56. Drag chain 52 is connected to manifold sled 144 by connection bracket 162 and drag chain mount plate 160.

Referring again to FIG. 1, a fluid conduit guide 58 is also provided in housing 10 and is located in the main chamber 24 along the lance chamber 22. Another fluid conduit guide 60 (best seen in FIG. 2) is located along the side of the main chamber 24 furthest from the lance chamber 22. The purpose of guides 58 and 60 is to isolate flexible fluid supply conduit 32 from an endless chain, which is used to extend and retract lances 36, as will be more fully described below.

Referring now to FIG. 2C, a section of housing 10 through line 2C—2C of FIG. 2 is seen showing fluid conduit guide 58. Fluid conduit guide 58 is conveniently attached to channel members 1 and 3 by welding. The center line of fluid conduit guide 58 is located at a distance from the center line of short legs 1*a* and 3*a* of channel members 1 and 3 such that flexible fluid supply conduit 32 slides freely between manifold channel 62 and fluid conduit guide 58. Referring again to FIG. 2, there is also provided a plate 61, which serves as a mounting platform for portions of one embodiment of a means for advancing and retracing lances 36 (for example, a hydraulic motor as will be more fully described below).

FIG. 2C also shows an embodiment of lance chamber 22 which is an alternative to that shown in FIG. 2B. According to the embodiment of FIG. 2C, lance chamber 22 is formed by channel member 200, which comprises metal, bent into a channel shape, as is known to those of skill in the art. If such an embodiment is used, plate 9 of FIG. 2B is bolted directly to bars (not shown) which are welded directly to channel member 200, through which an access hole is cut.

Figure 2F:
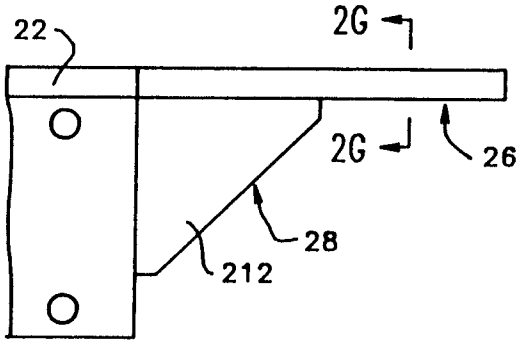
FIG. 2F is a detailed side view of the lance chamber extension of the cleaning apparatus shown in FIG. 2.
Figure 2G:
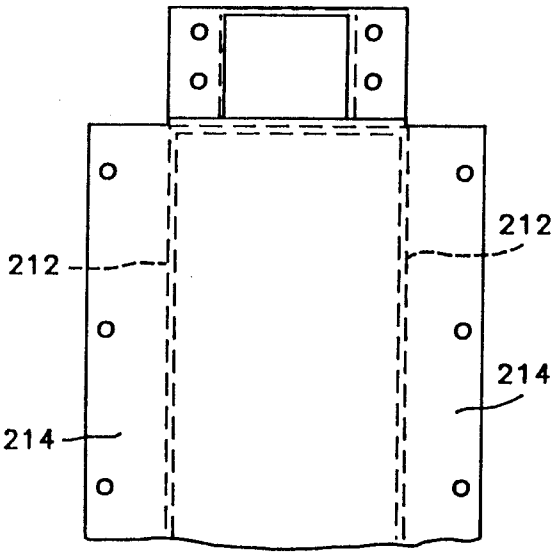
FIG. 2G is a section of the lance chamber extension taken through line 2G—2B of the cleaning apparatus shown in FIG. 2F.
Figure 2E:
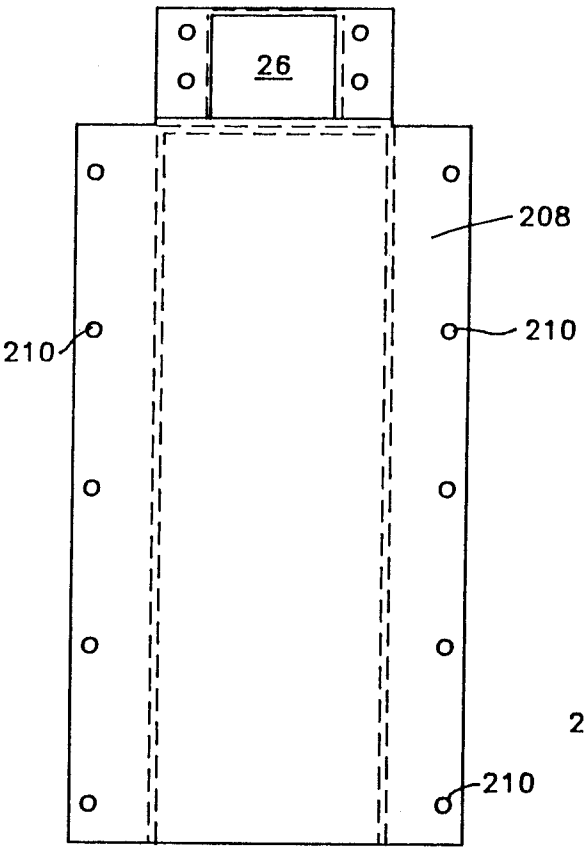
Figure 2D:
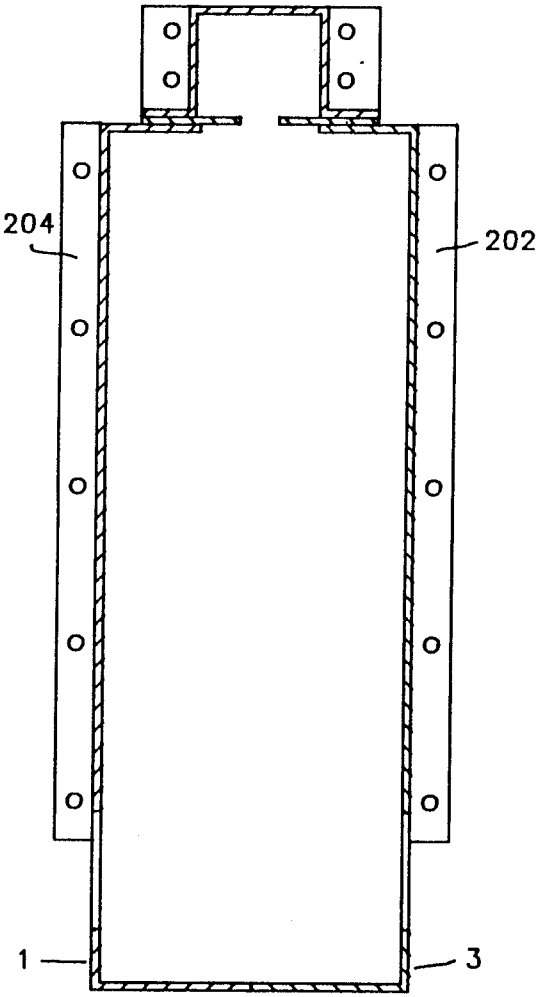

Referring now to FIG. 2D, a section of housing 10 through line 2D—2D of FIG. 2 is seen showing flange members 202 and 204, which are welded to channel members 1 and 3 and drilled through with holes 206. Referring now to FIG. 2E, a section of housing 10 through line E of FIG. 2 is seen showing lance chamber extension 26 and housing closure plate 208 for the proximate end 30 of housing 10. An opening in closure plate 208, having dimensions corresponding to lance chamber 22, is cut to provide for communication of fluid from lances 36 to lance chamber 22 through to lance chamber extension 26. Housing closure plate 208 includes holes 210 drilled through for mating with holes 206 (FIG. 2D). Closure plate 208 is attached to housing 10 by bolts inserted through holes 206 and 210.

Referring now to FIG. 2F and 2G, FIG. 2F shows a more detailed view of web 28 and FIG. 2G is a cross section through line 2G—2G of FIG. 2F. Web 28 comprises two plates 212 to which flange members 214 are welded.

Figure 4:
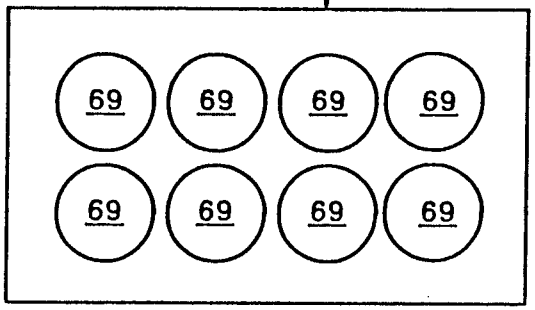
FIG. 4 is a front elevation view of an indexer, used according to one embodiment of the invention to guide the lances into the vertical heat exchange tube bundle to be cleaned.

Referring again to FIG. 1, in operation, lances 36 extend through lance chamber extension 26 (FIG. 2F) and into vertical bundle 20. Attached to the end of lance chamber extension 26 is an indexer 68 which matches the tube pattern of tube bundle 20. Tube bundles have a variety of patterns, and therefore, an embodiment of the invention contemplates using detachable and replaceable indexers, which allows for lances 36 to be guided into a variety of patterns of tubes. According to one embodiment (see FIG. 4), an indexer 68 is provided, which comprises a plate, o drilled through with eight holes 69, wherein the center of each hole 69 is aligned with any adjacent hole 69 in any adjacent row and column. Indexer 68 is removably connected by any means known to those of skill in the art (for example, by bolts or clamps). For example, see U.S. Pat. Nos. 4,856,545 and 5,031,691. According to an alternative embodiment, indexer 68 comprises a plate, drilled through with holes in two offset rows such that the centers of the holes are offset from any adjacent hole in an adjacent column. Other indexers may be used depending upon the pattern of the tubes in the heat exchanger to be cleaned.

Referring again to the embodiment of FIG. 1, water is supplied to input port 12 via shrouded hoses 100, which are of rubber and cloth construction as typical of 2 inch or 2½ inch firehose from a pump truck 102. An example of a suitable pump truck is described in U.S. Pat. No. 4,856,545. Other sources of high pressure water will occur to those of skill in the art. Also seen in the embodiment of FIG. 1 is one of several acceptable control means, here shown as control box 104, connected to hydraulic control lines 106 via remote control cable 108 and circuitry contained on truck 102, the specifics of which are known to those of skill in the art. According to the embodiment shown, the operator is able to stand at a safe distance from the face 110 of vertical heat exchanger 20 while stabbing lances 36 into tube bundle 20, controlling the flow of water through lances 36 and the direction of lances 36 through the tube bundle 20, all using control box 104.

A specific embodiment of an acceptable control system used by the operator is disclosed in U.S. Pat. No. 4,856,545, incorporated herein by reference. However, modifications to the '545 control system allowing a reduction in speed of the pump supplying pressure to the lances and allowing a small amount of water to exit the lances during stabbing has been found to be desirable. Such modifications are within the skill of those in the art.

Figure 5:
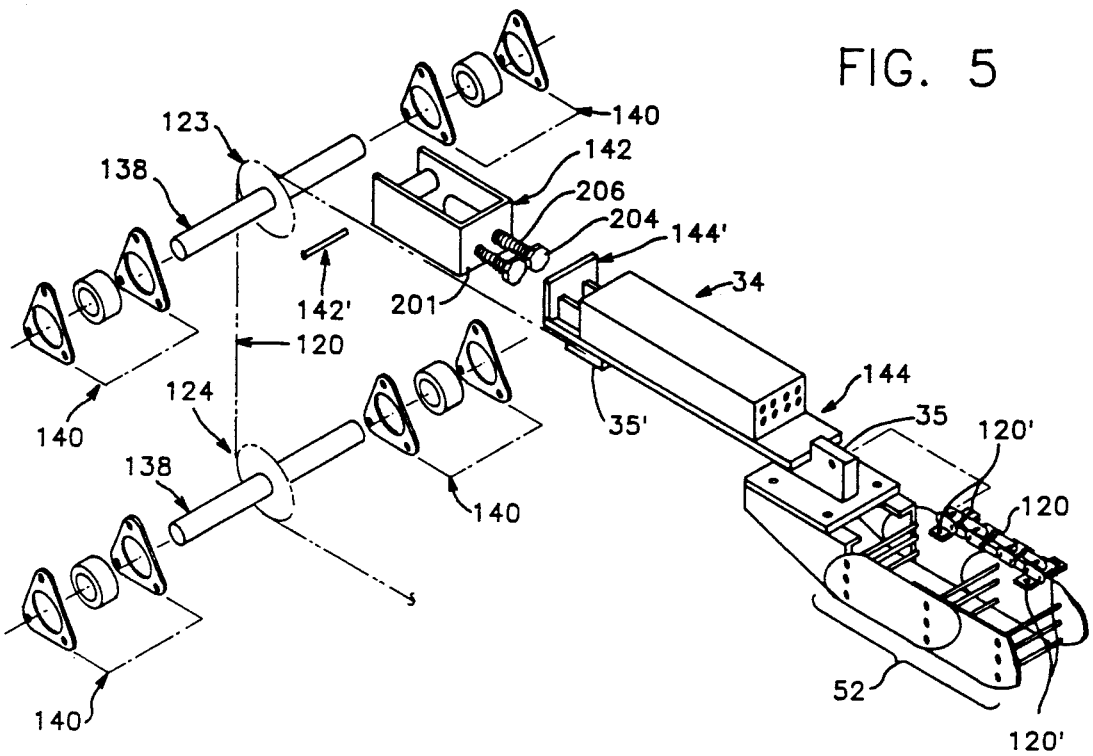
FIG. 5 is an exploded schematic view of the manifold block assembly at the closed end and other components in the lance retracted position.
Figure 6:
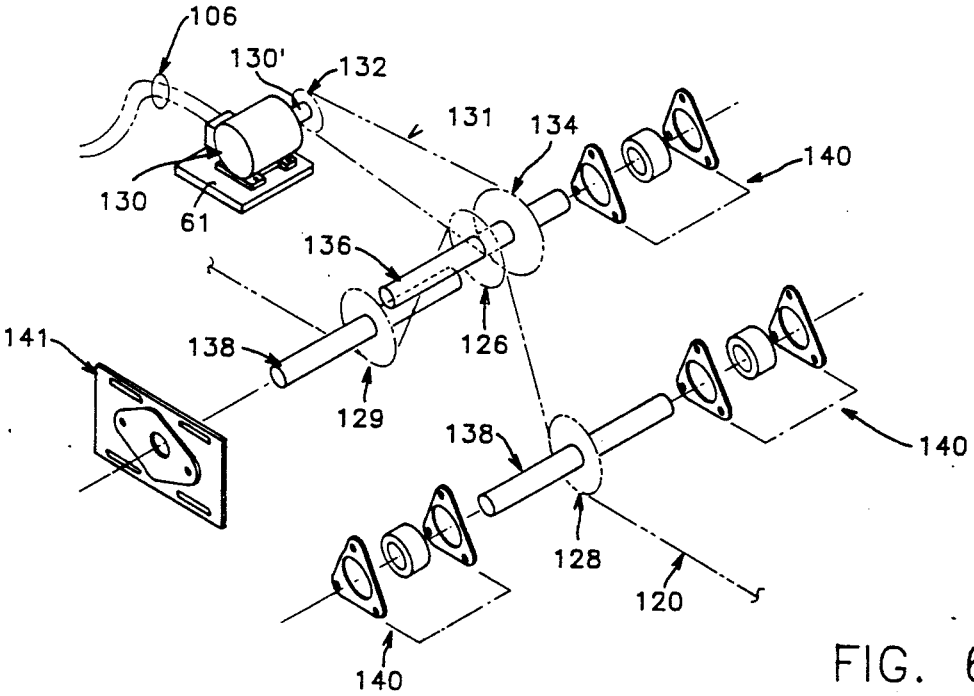
FIG. 6 is an exploded schematic view of the drive motor and gearing used to extend and retract the lances according to one embodiment of the invention.

Referring now to FIGS. 3, 5, and 6, there is shown in exploded schematic form a specific embodiment of an acceptable means for advancing and retracting lances 36 by moving the manifold 34 using a continuous chain. Referring specifically to FIG. 3 showing the apparatus with manifold 34 at the proximate end 30 of housing 10 wherein the lances are extended into the tubes and FIG. 5 showing it at the distal end 10*a*, the advancing and retracting means comprise a tension member (for example, an endless chain 120) connected to the manifold 34 by mounts 35 and 35' and mounted around four idler gears 121–124 (gears 121 and 122 are seen in FIG. 1), each idler gear being located in a corner of the main chamber 24 (FIG. 1). Endless chain 120 includes guide tabs 120, along the first 20 feet of endless chain 120 from manifold 34 to prevent the lances 36 from bending into o main chamber 24.

Referring now to FIG. 6, the endless chain 120 is further contacted by a drive gear 126 located in mid-region 11 (FIGS. 2 and 7) of the main chamber. Drive gear 126 (FIG. 6), is associated with two additional idler gears 128 and 129, which are provided to assure engagement of endless chain 120 with drive gear 126, thus increasing the number of teeth of drive gear 126 that are in contact with endless chain 120.

Drive gear 126 is driven by a reversible, variable speed, drive motor 130 (mounted on platform 61) which includes drive shaft axis 130', substantially perpendicular to the plane defined by drag chain 120. Drive motor 130 comprises a low speed - high torque motor (electric or hydraulic), capable of moving the lances at speeds and under loads known to those of skill in the art to occur in the cleaning of heat exchanger tubes. Motor 130 is controlled by control lines 106 as described above.

Motor 130 is connected to drive gear 126 by chain 131 and by sprockets 132 and 134. Motor 130 is mounted on plate 61 (FIGS. 2, 2C, and 7) by bolts through slotted holes on plate 61. Drive gear 134 is key mounted on drive shaft 136. Idler gears 128 and 124, and idler gears 121–124, are mounted on transfer shafts 138, which are mounted to housing 10 by shaft bearings 140. Referring specifically to FIG. 6, idler gear 129 is mounted on an adjustable bearing 141 for the purpose of adjusting the tension in o endless chain 120.

Referring specifically to FIG. 5, a shock absorber 142 is shown which contacts manifold sled 144 when manifold 34 is in the retracted position. Manifold 34 is mounted to sled 144 which is connected to endless chain mounts 35 and 35'. Shock absorber 142 will be described more fully below.

Figure 7:
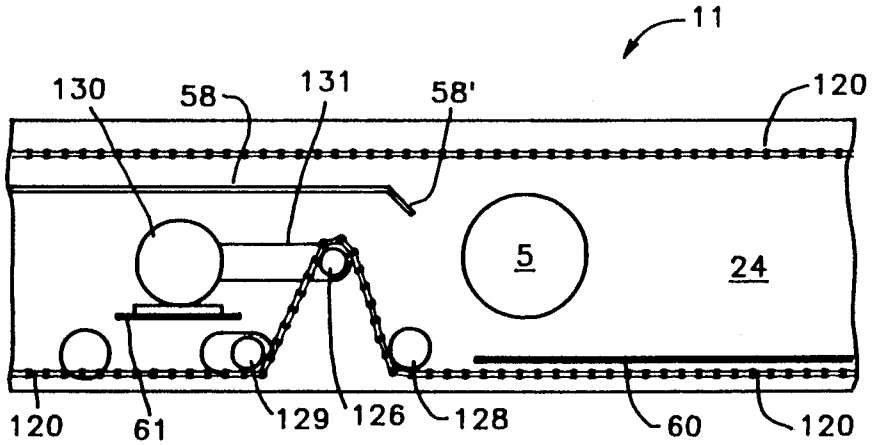
FIG. 7 is a side view of the mid-section of the housing of FIG. 2, showing an embodiment of a means for driving the manifold carrying the lances.

Referring now to FIG. 7, there is shown a more detailed view of the mid-region 11 of housing 10 in which plate 61 is mounted, showing motor 130 (mounted to plate 61) and chain 131 connected between motor 130 and drive gear 126. FIG. 7 also shows in more detail the relationship between endless chain 120, guides 58 and 60, and gears 126, 128 and 129. Also seen is guide tab 58', which is connected to or alternatively, integrally formed with guide 58 at about a 45 degree angle. Such a guide tab 58' allows for a funneling effect to funnel flexible fluid supply conduit 32 along guide 58. Flexible fluid supply conduit 32 travels between endless chain 120 and guide 58 when the lances 36 are being retracted.

Figure 11:
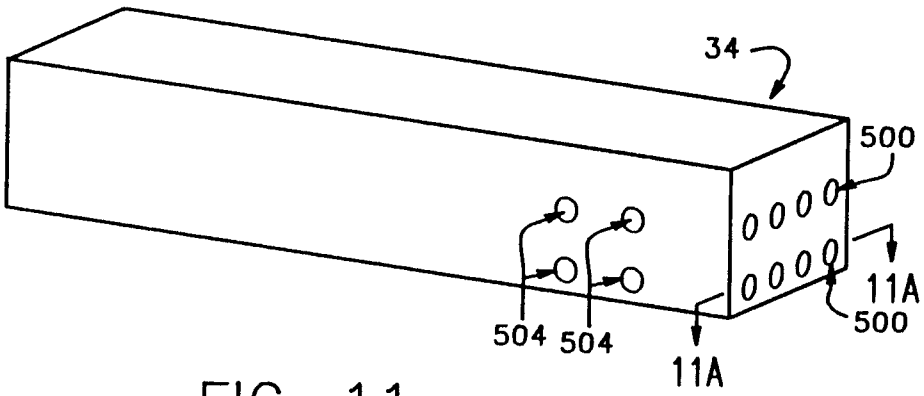
FIG. 11 is a three dimensional perspective view of a manifold block useful with one embodiment of the invention.
Figure 8:
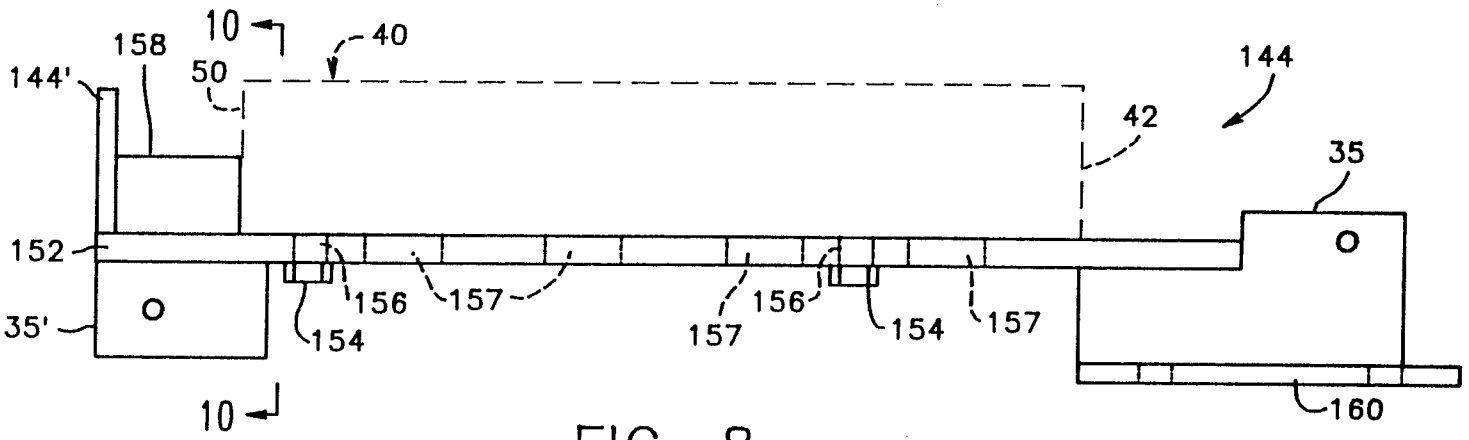
FIG. 8 is a side elevational view of the manifold sled assembly of FIG. 5.

Referring now to FIG. 8, there is shown a more detailed embodiment of the manifold sled 144 showing manifold block 40 attached to sled 152 (for example, an A-36 steel ⅜ inch×3 inch F.B.×15 inch plate) by bolts 154 passing through holes 156 and screwed into block 40. One inch holes 157 are also provided as a manifold fluid input opening for fluid connectors 46 to pass through and be screwed into block 40. Referring to FIG. 11, an embodiment of manifold 34 is shown. According to this embodiment, manifold 34 includes passages holes 500 drilled for connecting eight lances to the manifold fluid supply into a fluid distribution chamber 502 (FIG. 11A) within manifold 34, such that interior pressure is relieved from a blocked lance through the other lances, lessening the chance that a lance may burst when encountering a blocked tube. According to an alternative embodiment, twelve lances may be used.

Figure 11A:
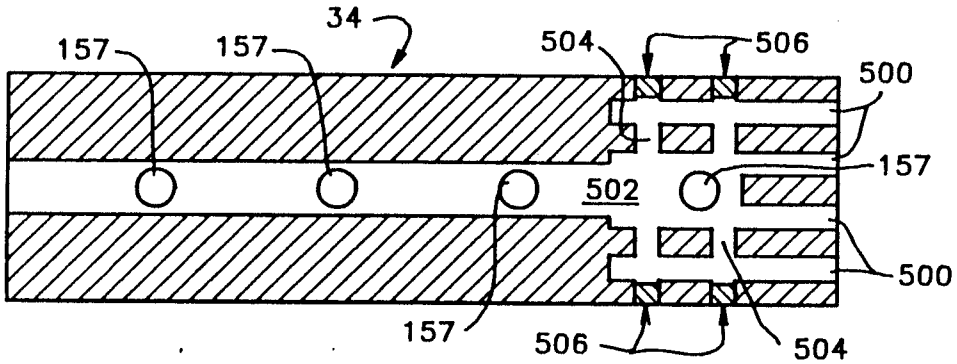
FIG. 11A is a section view through line 11A—11A of FIG. 11.

Referring still to FIG. 11A, lance passages 500 are connected to fluid distribution chamber 502 by horizontal chambers 504, drilled through manifold 34 across each row of lance passages 500, as best seen in FIG. 11. Horizontal passages 504 are stopped by plugs 506 (FIG. 11A). Also seen in FIG. 11A, fluid holes 157 are shown drilled through manifold 34 and terminating in fluid distribution chamber 502. Thus, each of lance passages 500 is in fluid communication with each of fluid supply holes 157.

Figure 9:
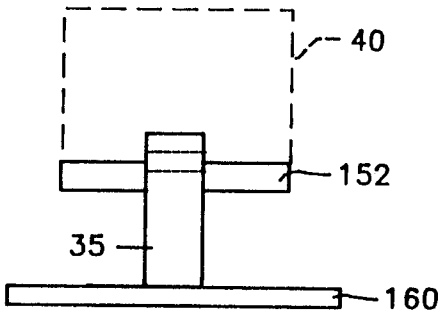
FIG. 9 is an end view of the manifold assembly of FIG. 5.

Referring now to FIG. 9, an end view of sled 144 from location 10—10 of FIG. 8 is seen showing endless chain mount 35 connected to drag chain mount 160 by welding. Sled 152 is attached to endless chain mount 35 by welding.

Figure 10:
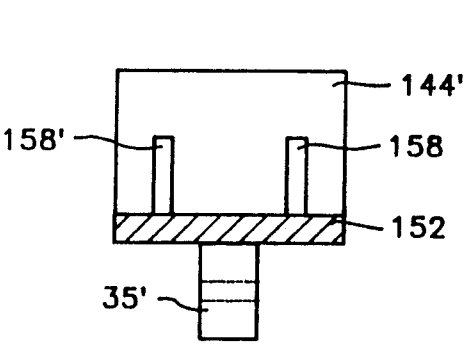
FIG. 10 is a cross sectional view taken through line 10—10 of FIG. 8 of the manifold assembly.

Referring now to FIG. 10, a cross section of sled 144 is shown through line 10—10 of FIG. 8 in which endless chain mount 35' is attached to sled member 152 by welding. Support members 158 and 158' are attached to sled member 152 by welding. Rear impact member 144' is welded to sled member 152.

Referring again to FIG. 5, shock absorber 142, which is mounted to housing 10 by inserting a pin 142, through corresponding holes located in channels 7 (FIG. 2B), comprises U-bracket 201 having formed therein cylinders 202 (one shown) which receive pistons 204 and springs 206. Pistons 204 contact rear impact member 144' in the event sled 144 is retracted too far, thus reducing the likelihood of damage.

From the foregoing description of the present invention and accompanying drawings, one skilled in the art should be enabled to practice this invention. The especially prepared embodiments described are the best mode to practice this invention which is presently known. Other embodiments will occur to those of skill in the art which do not depart from the fair scope of the invention, the above-described embodiments being provided by way of illustration only and not by limitation.

What is claimed is:

1. A device for use with a main fluid supply conduit for simultaneously hydroblasting the interior of a plurality of tubes in a heat exchanger tube bundle comprising:

a housing having:

an input port adapted to receive the main fluid supply conduit, an open end, a closed butt end, sides defining a main chamber and a lance chamber, wherein the main chamber and the lance chamber are separated within the housing by a manifold channel;

a manifold slidably carried along the manifold channel and having a manifold input in fluid communication with a plurality of manifold outputs facing the open end of the housing;

a flexible fluid supply conduit connected between the input port and the manifold input; wherein the flexible fluid supply conduit is connected to the manifold such that when the manifold is in a lance retracted position, a bight portion of the flexible fluid supply conduit extends toward the open end; and a plurality of hollow lances, each connected to one of the manifold outputs; wherein the lances are extendable and retractable through the open end, and wherein fluid supplied by the main fluid supply conduit passes through the input port, through the flexible fluid supply conduit, through the manifold, and through the lances;

whereby the orientation of said bight portion during hydroblasting of a vertically oriented tube bundle prevents binding of said flexible fluid supply conduit.

2. A device as in claim 1 wherein the flexible fluid supply conduit is connected to the manifold input by a hollow short radius connector having a manifold connection end and a fluid conduit connection end, wherein the fluid conduit connection end defines an opening which faces the open end of the housing.

3. A device as in claim 2 wherein the short radius connector comprises an L-shaped connector.

4. A device as in claim 1 wherein an output portion of the flexible fluid supply conduit is positioned in the main chamber substantially parallel to the lances when the lances are in the retracted position.

5. A device as in claim 1 wherein the input port is positioned to minimize the length of the flexible fluid supply conduit.

6. A device as in claim 5 wherein the input port is positioned in the mid-region of the housing

7. A device as in claim 6 wherein an output portion of the flexible fluid supply conduit is positioned substantially parallel to the lances when the lances are in the retracted position.

8. A device for use with a main fluid supply conduit for simultaneously hydroblasting the interior of a plurality of tubes in a heat exchanger tube bundle comprising:

a housing having:

an input port adapted to receive the main fluid supply conduit, an open end, a closed butt end, and sides defining a main chamber and a lance chamber, wherein the main chamber and the lance chamber are separated within the housing by a manifold channel;

a manifold slidably carried along the manifold channel and having a manifold input in fluid communication with a plurality of manifold output openings facing the open end of the housing;

a flexible fluid supply conduit with one end connected to the input port and the other to the manifold input by a hollow short radius connector having a manifold connection end and a fluid conduit connection end, wherein the fluid conduit connection end faces the open butt end of the housing;

a plurality of hollow lances, extendable and retractable through the open end of the housing, each connected to one of the manifold output openings;

wherein the input port is positioned to minimize the length of the flexible fluid supply conduit, wherein the flexible fluid supply conduit is connected to the manifold input such that when the manifold is in a lance retracted position, a bight portion of the flexible fluid supply conduit extends toward the open butt end and is positioned in the main chamber substantially parallel to the lances when the lances are in the retracted position, whereby the orientation of said bight portion during hydroblasting of a vertically oriented tube bundle presents binding of said flexible fluid supply conduit.

* * * * *